United States Patent [19]

Johnson et al.

[11] 4,068,347

[45] Jan. 17, 1978

[54] HANDLE HINGE TO TRANSFER LIFTING FORCE IN A DIRECTION PARALLEL AND NORMAL TO MOUNTING WALL

[76] Inventors: Bennie R. Johnson, R.R. 1; Gary L. Cox, 1920 Virginia Ave., both of Connersville, Ind. 47331

[21] Appl. No.: 718,152

[22] Filed: Aug. 27, 1976

[51] Int. Cl.[2] ..... A47B 45/02

[52] U.S. Cl. ..... 16/112; 27/2

[58] Field of Search ..... 16/112, 126; 27/2, 27, 27/6, 35

[56] References Cited

U.S. PATENT DOCUMENTS

| | | | |
|---|---|---|---|
| 763,799 | 6/1904 | Schehr | 16/112 |
| 1,227,929 | 5/1917 | Ralston | 16/112 |
| 1,427,603 | 8/1922 | Kallmeyer | 16/112 |
| 2,163,830 | 6/1939 | Clifford | 16/112 |
| 2,436,598 | 2/1948 | Pastor et al. | 16/112 |
| 3,699,611 | 10/1972 | Johnson | 16/114 R |

*Primary Examiner*—Andrew V. Kundrat

*Attorney, Agent, or Firm*—Woodard, Weikart, Emhardt & Naughton

[57] ABSTRACT

A handle hinge mounted to a container wall which transfers the lifting force in a direction parallel and normal to the container wall. A base plate is mounted to the side wall of the container to be lifted by a lifting arm pivotally mounted to the base. The base includes an exterior stop surface and an interior stop surface which are simultaneously contacted respectively by a ledge formed on the lifting arm and the distal end of a finger projecting into the base from the lifting arm. The interior and exterior stop surfaces are positioned so as to transfer lifting force in a direction parallel to and perpendicular to the side wall of the container. In one embodiment, a pair of interior stop surfaces are provided whereas in another embodiment, four interior stop surfaces are provided, all of which contact the flat distal end of the finger mounted to the lifting arm. A carrying bar is fixedly mounted to the bottom ends of a pair of spaced apart lifting arms pivotally mounted to a pair of bases in turn attached to the container side wall.

8 Claims, 9 Drawing Figures

HANDLE HINGE TO TRANSFER LIFTING FORCE IN A DIRECTION PARALLEL AND NORMAL TO MOUNTING WALL

BACKGROUND OF THE INVENTION

1. Field of the Invention

This invention is in the field of handles.

2. Description of the Prior Art

A number of U.S. patents have been granted disclosing pivoting handles attached to caskets. Disclosed herein is a new and improved pivoting casket handle which transfers the lifting force to the casket side wall in such a manner to minimize the tear away force exerted between the handle and the casket side wall. Many of the prior art casket handles are designed so that the lifting force is applied to the casket side wall in a number of different angles with the end result that the casket handle base plate is forced to rotate thereby ripping the base plate from the casket side wall. Typically, the prior art handles apply the lifting force in a direction to urge the bottom edge of the base plate away from the casket side wall while simultaneously urging the top edge of the base plate toward the casket side wall resulting in rotation of the base plate. This problem is alleviated by the hinge or handle disclosed herein.

In the U.S. Pat. No. 1,954,485 issued to R. A. McClelland, there is disclosed a casket handle wherein the lifting force is applied to the base plate causing the plate to rotate. In the U.S. Pat. 2,098,421 issued to B. F. Johnson, the lifting arm applies outwardly directed force to the base plate. In the U.S. Pat. No. 3,698,037 issued to Bennie R. Johnson, the lifting force is applied in a direction perpendicular to the mounting wall whereas in the U.S. Pat. No. 3,699,611, the lifting force is applied by the lifting arm directly engaging the casket wall.

SUMMARY OF THE INVENTION

One embodiment of the present invention is a handle hinge mountable to a wall comprising a base adapted to be mounted onto the wall, the base having a first exterior stop surface and a second interior stop surface, the interior stop surface extending perpendicular to the wall, a lifting arm having a proximal end pivotally mounted to the base and means on the base and engaged with the lifting arm operable to allow the lifting arm to be pivoted from a downward position near the wall to an upward position away from the wall, the lifting arm having a curved finger with a tip extending into the base from the proximal end and with the arm further having a ledge, the tip and the ledge being positioned to simultaneously contact respectively the interior stop surface and the exterior stop surface when the arm is in the upward position to direct at least some of the lifting force parallel to the wall.

Another embodiment of the present invention is a handle hinge comprising a base having a front surface with an opening thereon with the base being securable to a wall, the base having stop surfaces parallel to and perpendicular to the wall and an arm hingedly mounted to the base and having a finger projecting through the opening contacting at least one of the stop surfaces in a direction parallel to the wall while the arm simultaneously contacts another of the stop surfaces in a direction perpendicular to the wall respectively distributing lifting force applied to the arm to the base in a direction parallel and perpendicular to the wall.

It is an object of the present invention to provide a new and improved lifting handle.

Another object of the present invention is to provide a handle mountable to a wall with the handle applying lifting force in a direction normal and toward the side wall while simultaneously applying the remaining portion of the lifting force in a downward direction parallel to the wall.

Related objects and advantages of the present invention will be apparent from the following description.

DESCRIPTION OF THE PREFERRED EMBODIMENTS

Figure 1:
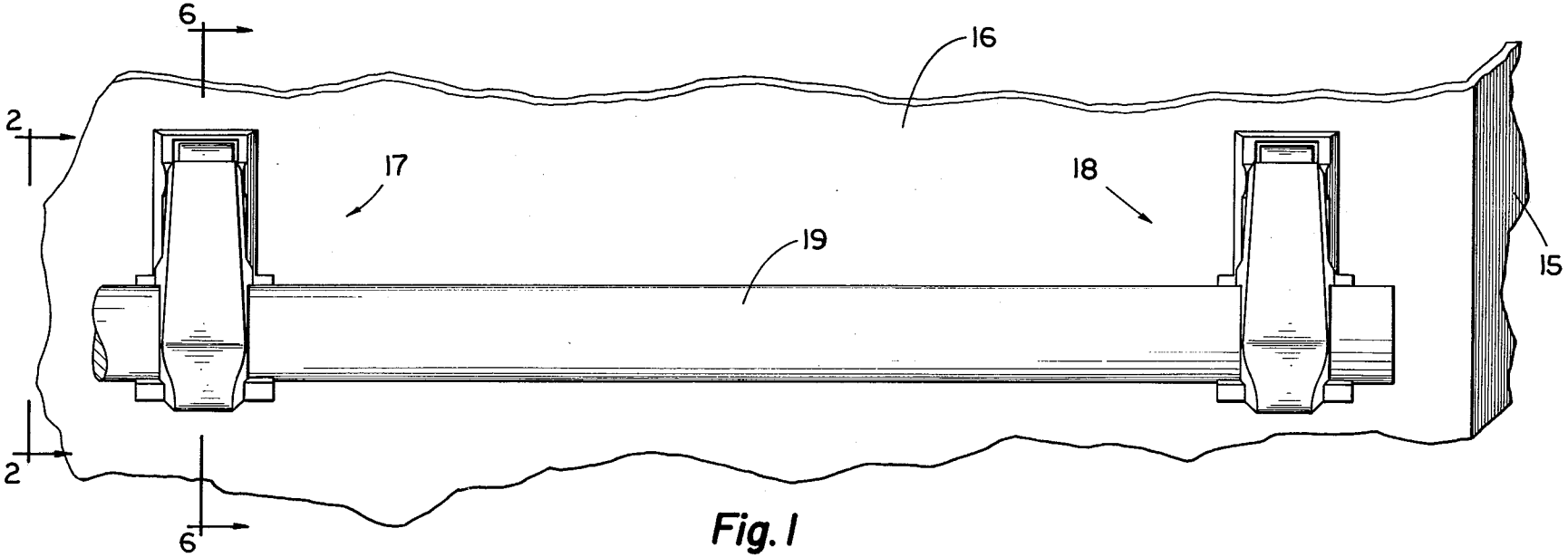
FIG. 1 is a fragmentary front view of a pair of handles mounted to a casket side wall in accordance with the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a casket or container 15 having a side wall 16. A pair of lifting handles 17 and 18 are fixedly mounted to wall 16 with a carrying bar 19 extending between and mounted to lifting handles 17 and 18.

Lifting handle 17 will now be described, it being understood that a similar description applies to lifting handle 18. Lifting handle 17 includes a base 20 (FIG. 2) fixedly mounted to side wall 16 with a lifting arm 21 pivotally mounted to base 20. Base 20 (FIG. 4) is adapted to be mountable to wall 16 by standard fastening devices such as screws. The base includes a hollow main body provided with a pair of side walls 23 integrally joined to a pair of end walls 24 and 25. An opening 26 is provided through which finger 36 (FIG. 5) attached to the proximal end 27 of arm 21 projects. A pair of mounting bosses 29 and 30 are integrally mounted to the front wall 31 of the base.

Figure 4:
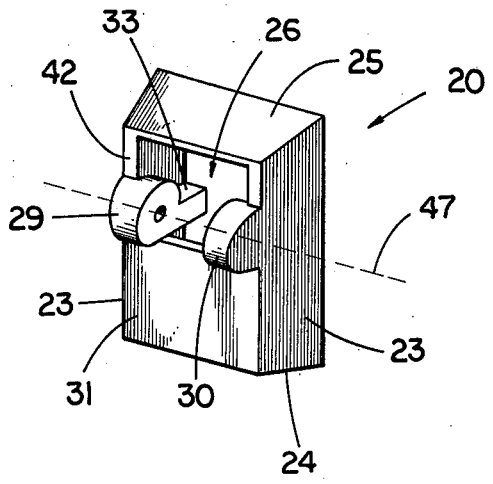
FIG. 4 is an enlarged perspective view of the base plate of one of the handles shown in FIG. 1 with the lifting arm removed therefrom.
Figure 5:
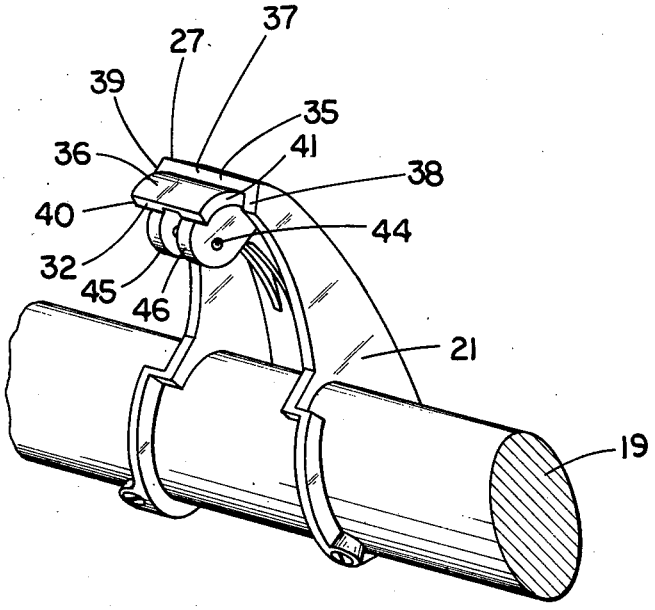
FIG. 5 is an enlarged perspective view of the back of one of the lifting arms shown in FIG. 1.

Lifting arm 21 includes the curved finger 36 having a tip 32 for engaging interior stop surfaces 33 (FIG. 4)

and 34 (FIG. 6) formed on base 20. A ledge or shoulder 35 (FIG. 5) includes a portion thereof 37 extending across the top surface of curved finger 36. Likewise, shoulder 35 includes downwardly-extending surfaces 38 and 39 which extend outwardly and across the opposite ends 40 and 41 of finger 36 thereby extending 270° around finger 36. Portion 37 and surfaces 38 and 39 of shoulder 35 are perpendicular to finger 36.

Figure 3:
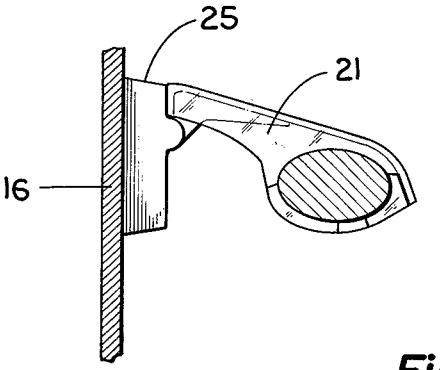
FIG. 3 is the same view as FIG. 2 only showing the lifting arm in the upward extended position.

Extending around opening 26 of base 20 is an exterior stop surface 42 which is contacted by shoulder 35 when the lifting arm is pivoted to the upward position shown in FIG. 3. Simultaneously with the contacting of shoulder 35 with exterior stop surface 42, the flat tip 32 of finger 36 contacts stop surfaces 33 and 34.

Figure 6:
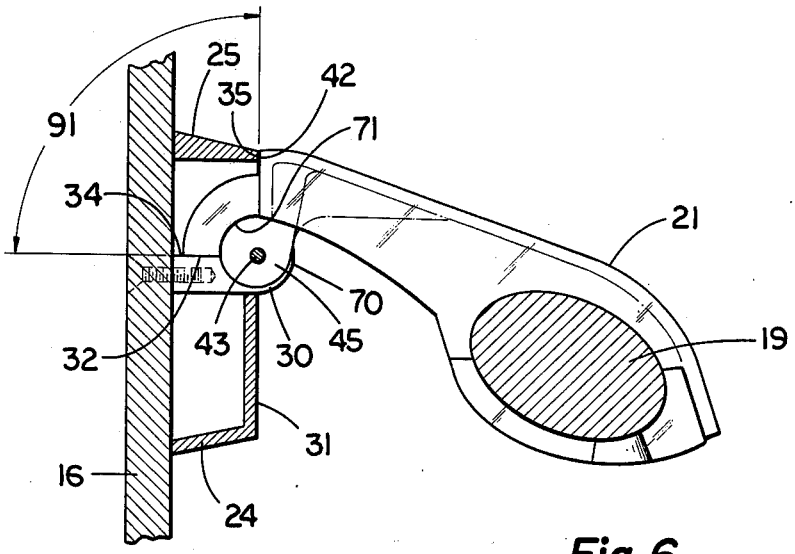
FIG. 6 is an enlarged cross-sectional view taken along the line 6—6 of FIG. 1 and viewed in the direction of the arrows.

Pin 43 (FIG. 6) is mounted to bosses 29 and 30 and extends across the gap therebetween. Likewise, pin 43 extends through apertures 44 (FIG. 5) of mounting walls 45 and 46 integrally attached to the bottom surface of finger 36. Thus, lifting arm 21 may be pivoted about a pivot axis extending centrally through pivot pin 43. As shown in FIG. 6, surface 34 is perpendicular to side wall 16 whereas exterior stop surface 42 is parallel to wall 16. Thus, the lifting force applied to the carrying handle 19 is directed via tip 32 and surface 34 in a direction parallel to side wall 16 while simultaneously the remaining portion of the lifting force is directed through shoulder 35 in a direction perpendicular to side wall 16. Shoulder 35 and surface 42 are parallel to side wall 16 when the arm is in the upward position.

The exterior stop surface formed by shoulder 35 lies in a plane parallel to side wall 16 with the plane containing pivot axis 47, thereby transferring lifting force onto the exterior stop surface 42 and interior stop surface 34 in lieu of the pivot pin. In the embodiment shown in FIG. 5, walls 45 and 46 fit adjacent and between bosses 29 and 30.

Figure 7:
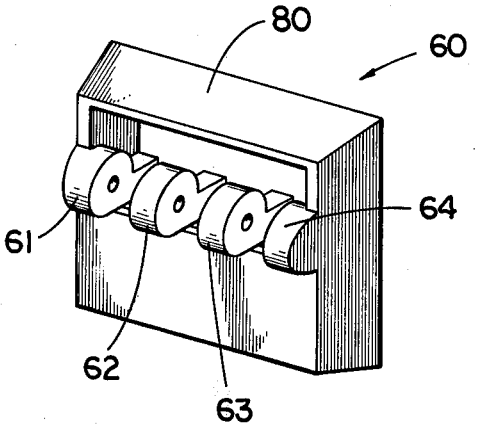
FIG. 7 is the same view as FIG. 4 only showing an alternate embodiment of the base plate.
Figure 8:
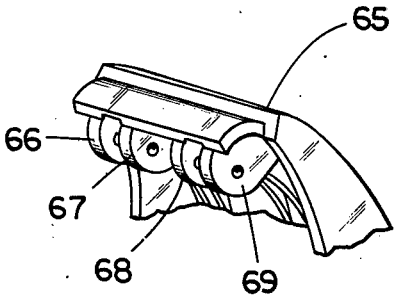
FIG. 8 is the same view as FIG. 5 only showing a fragment of an alternate embodiment of the lifting arm.

In an alternate embodiment shown in FIGS. 7 and 8, four separate mounting flanges are provided, one for each mounting boss of the base plate. Base plate 60 is identical to base plate 20 with the exception that four mounting bosses 61 through 64 are provided. Likewise, lifting arm 65 is identical to lifting arm 21 with the exception that four mounting flanges 66 through 69 are provided. Mounting flanges 66 and 67 are positioned adjacent and between mounting bosses 63 and 64. Mounting flanges 68 and 69 are positioned adjacent and between mounting bosses 61 and 62. A pivot pin or pivot pins are used to mount the mounting flanges 66 through 69 to mounting bosses 61 through 64. Mounting flange 66 is positioned inwardly of and adjacent boss 64 whereas mounting flange 67 is positioned adjacent mounting boss 63 between bosses 63 and 64. Flange 68 is positioned between bosses 61 and 62 immediately adjacent boss 62 whereas flange 69 is positioned inwardly of and adjacent boss 61.

Figure 2:
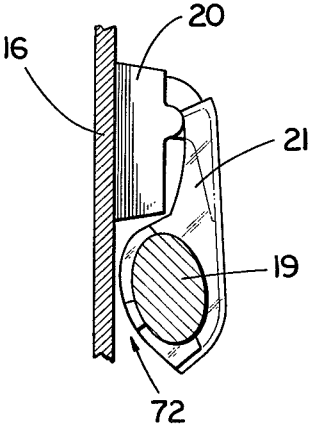
FIG. 2 is an end view of one of the handles of FIG. 1 looking in the direction of arrows 2—2.

Each mounting boss 29, 30, 61 through 64 is provided with a curved outer surface 70 which bearing receives the curved downwardly-facing bottom surface 71 (FIG. 6) of the lifting arm to facilitate the pivoting motion of the lifting arm from the downward position shown in FIG. 2 to the upward position shown in FIG. 3. The lifting arm and carrying bar are sized and configured and are provided with a center of gravity in such a manner so as to space all portions of the lifting arm and lifting bar away from wall 16 providing a gap 72 (FIG. 2) when the arm is in the downward position. The finger of lifting arm 21 is identical to the finger of lifting arm 65 with the top surface of the finger being convex and with the opposite sides 40 and 41 (FIG. 5) being parallel extending downwardly from the top convex surface. Ledge 35 is normal to the convex surface 70 of finger 36 and surfaces 38 and 39. The ledge or shoulder 35 is in entire contact along portion 37 and surfaces 38 and 39 with the exterior stop surface 42 (FIG. 6) when the arm is in the upward position.

Bases 20 and 60 are relatively small in configuration being almost completely concealed when arms 21 and 65 are in the upward or downward position. For example, most of wall 25 and wall 80 of bases 20 and 60 are concealed from a viewer looking in the direction perpendicular to wall 16 (FIG. 3) when the lifting arm is pivoted in the upward direction. This is true since the top wall is blended into the upwardly facing surface of the lifting arm. Likewise, when the arm is pivoted to the downward position, the bottom edge portion of the base is concealed by the arm as shown in FIG. 1 and when viewed in the direction perpendicular to the wall. At least some portions of the base are observable when looking toward the casket side wall; however, most of the base is concealed by the lifting arm as contrasted to the prior art bases which extend a considerable distance upward from the lifting arm in order to provide a suitable foundation for securing to the casket side wall. Such securement is not necessary with the handle hinge disclosed herein since the lifting force is applied in a direction perpendicular to and normal to the casket side wall.

Figure 9:
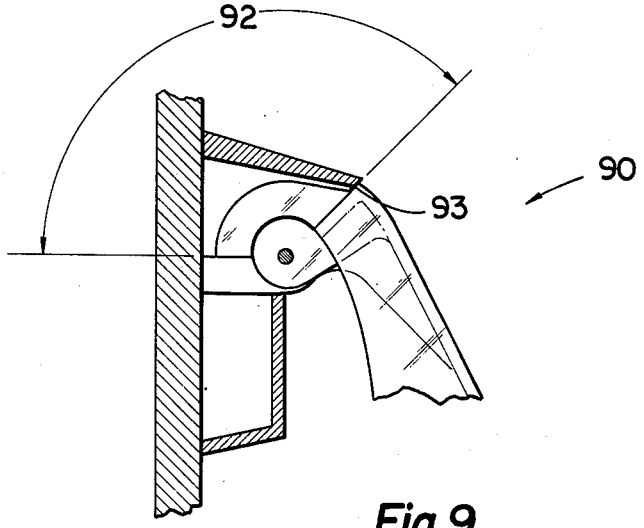
FIG. 9 is the same view as FIG. 6 only showing a fragment thereof and showing yet another alternate embodiment of the present invention.

Yet another embodiment of the lifting handle is shown in FIG. 9. Lifting handle 90 is identical to the handles previously described either incorporating a pair of bosses for the embodiment shown in FIG. 4 or four bosses such as shown in FIG. 7. The only difference between lifting handle 90 and the previously-described lifting handles is the fact that angle 92 (FIG. 9) extending between the exterior and interior stop surfaces is approximately 135° whereas angle 91 (FIG. 6) extending between the interior and exterior stop surfaces is 90°. Thus, the lifting force will be applied in a direction parallel to the casket side wall at the location of the interior stop surface whereas at the exterior stop surface 93, the lifting force will be applied in a direction upwardly of approximately 45°.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

We claim:

1. A handle hinge mountable to a wall comprising:

a base adapted to be mounted onto said wall, said base having a first exterior stop surface and a second interior stop surface, said interior stop surface extending perpendicular to said wall;

a lifting arm having a proximal end pivotally mounted to said base;

means on said base and engaged with said lifting arm operable to allow said lifting arm to be pivoted from a downward position near said wall to an upward position away from said wall;

said lifting arm having a curved finger with a tip extending into said base from said proximal end and with said arm further having a ledge, said tip and said ledge being positioned to simultaneously contact respectively said interior stop surface and said exterior stop surface when said arm is in said upward position to direct at least some of said lifting force parallel to said wall;

said exterior stop surface extends parallel to said wall and wherein said lifting force is directed against said interior stop surface and said exterior stop surface when said arm is in said upward position allowing said lifting force to be respectively directed parallel to and perpendicular against said wall;

said means includes a pivot axis around which said lifting arm pivots, said exterior stop surface lies in a first plane which contains said pivot axis transferring lifting force onto said exterior stop surface and interior stop surface in lieu of said means;

said lifting arm includes a mounting wall integrally secured thereto and projecting inwardly into said base adjacent said means which includes a pivot pin mounted to and extending between said base and said mounting wall; said lifting arm includes a plurality of said mounting walls pivotally mounted to said base.

2. A handle hinge mountable to a wall comprising:

a base adapted to be mounted onto said wall, said base having a first exterior stop surface and a second interior stop surface, said interior stop surface extending perpendicular to said wall;

a lifting arm having a proximal end pivotally mounted to said base;

means on said base and engaged with said lifting arm operable to allow said lifting arm to be pivoted from a downward position near said wall to an upward position away from said wall;

said lifting arm having a curved finger with a tip extending into said base from said proximal end and with said arm further having a ledge, said tip and said ledge being positioned to simultaneously contact respectively said interior stop surface and said exterior stop surface when said arm is in said upward position to direct at least some of said lifting force parallel to said wall;

said exterior stop surface extends parallel to said wall and wherein said lifting force is directed against said interior stop surface and said exterior stop surface when said arm is in said upward position allowing said lifting force to be respectively directed parallel to and perpendicular against said wall;

said means includes a pivot axis around which said lifting arm pivots, said exterior stop surface lies in a first plane which contains said pivot axis transferring lifting force onto said exterior stop surface and interior stop surface in lieu of said means;

said lifting arm includes a mounting wall integrally secured thereto and projecting inwardly into said base adjacent said means which includes a pivot pin mounted to and extending between said base and said mounting wall;

said base includes at least three spaced apart bearing bosses integrally mounted thereon and extending outwardly therefrom, said bosses have curved outer surfaces to bearingly receive and support said proximal end of said lifting arm;

said lifting arm includes a plurality of said mounting walls with each of said mounting walls pivotally mounted to said bosses.

3. The combination of:

a container having a side wall;

a handle hinge mountable to a wall including a base adapted to be mounted onto said wall, said base having a first exterior stop surface and a second interior stop surface, said interior stop surface extending perpendicular to said wall;

a lifting arm having a proximal end pivotally mounted to said base;

means on said base and engaged with said lifting arm operable to allow said lifting arm to be pivoted from a downward position near said wall to an upward position away from said wall;

said lifting arm having a curved finger with a tip extending into said base from said proximal end and with said arm further having a ledge, said tip and said ledge being positioned to simultaneously contact respectively said interior stop surface and said exterior stop surface when said arm is in said upward position to direct at least some of said lifting force parallel to said wall;

said exterior stop surface extends parallel to said wall and wherein said lifting force is directed against said interior stop surface and said exterior stop surface when said arm is in said upward position allowing said lifting force to be respectively directed parallel to and perpendicular against said wall;

a carrying bar mounted to said lifting arm;

at least two of said handle hinges with said carrying bar fixedly mounted to said lifting arm of each handle hinge, each lifting arm includes a distal end through which said carrying bar extends, and wherein said container is a casket;

said finger has a top convex surface and opposite parallel sides extending downwardly from said surface, said ledge having a contact surface which extends across said convex surface and across said parallel sides and is normal to said convex surface and parallel sides, said contact surface of said ledge is in entire contact with said base when said arm is in said upward position.

4. A handle hinge mountable to a wall comprising: a base adapted to be mounted onto said wall, said base having a first exterior stop surface and a second interior stop surface, said interior stop surface extending perpendicular to said wall;

a lifting arm having a proximal end pivotally mounted to said base;

means on said base and engaged with said lifting arm operable to allow said lifting arm to be pivoted from a downward position near said wall to an upward position away from said wall;

said lifting arm having a curved finger with a tip extending into said base from said proximal end and with said arm further having a ledge, said tip and said ledge being positioned to simultaneously contact respectively said interior stop surface and said exterior stop surface when said arm is in said upward position to direct at least some of said lifting force parallel to said wall; and wherein:

said finger has a top convex surface and opposite parallel sides extending downwardly from said surface, said ledge having a contact surface which extends across said convex surface and across said parallel sides and is normal to said convex surface and parallel sides, said contact surface of said ledge is in entire contact with said base when said arm is in said upward position.

5. The handle hinge of claim 4 wherein said lifting arm includes a plurality of mounting walls integrally secured thereto and projecting inwardly into said base adjacent said means which includes a pivot pin mounted to and extending between said base and said mounting walls.

6. The handle hinge of claim 4 wherein said means includes a pivot axis around which said lifting arm pivots and said contact surface is located entirely above said pivot axis.

7. The handle hinge of claim 4 wherein said first exterior stop surface and said interior stop surface are located to form an included angle therebetween of greater than 90° directing some of said lifting force in an upward direction.

8. A handle hinge mountable to a wall comprising:

a base adapted to be mounted onto said wall, said base having a first exterior stop surface and a second interior stop surface, said interior stop surface extending perpendicular to said wall;

a lifting arm having a proximal end pivotally mounted to said base;

means on said base and engaged with said lifting arm operable to allow said lifting arm to be pivoted from a downward position near said wall to an upward position away from said wall;

said lifting arm having a curved finger with a tip extending into said base from said proximal end and with said arm further having a ledge, said tip and said ledge being positioned to simultaneously contact respectively said interior stop surface and said exterior stop surface when said arm is in said upward position to direct at least some of said lifting force parallel to said wall; and wherein:

said lifting arm includes a plurality of mounting walls integrally secured thereto and projecting inwardly into said base adjacent said means which includes a pivot pin mounted to and extending between said base and said mounting walls.

* * * * *